US009653046B1

(12) United States Patent
Tang

(10) Patent No.: US 9,653,046 B1
(45) Date of Patent: May 16, 2017

(54) FOLDABLE GUITAR

(71) Applicant: Kai-Hua Tang, Taichung (TW)

(72) Inventor: Kai-Hua Tang, Taichung (TW)

( * ) Notice: Subject to any disclaimer, the term of this patent is extended or adjusted under 35 U.S.C. 154(b) by 0 days.

(21) Appl. No.: 15/362,255

(22) Filed: Nov. 28, 2016

(51) Int. Cl.
*G10D 1/08* (2006.01)

(52) U.S. Cl.
CPC ..... *G10D 1/08* (2013.01)

(58) Field of Classification Search
CPC ..... G10D 1/08
USPC ..... 84/291
See application file for complete search history.

(56) References Cited

U.S. PATENT DOCUMENTS 3,910,151 A * 10/1975 Copeland ..... G10D 1/08 84/267
4,073,211 A * 2/1978 Jorgensen ..... G10D 3/06 84/267
4,111,093 A * 9/1978 Field ..... G10D 3/06 84/267
4,191,085 A * 3/1980 Litwin ..... G10D 3/06 84/291
4,592,265 A * 6/1986 Steinberger ..... G10G 5/005 84/327
4,632,002 A * 12/1986 Clevinger ..... G10H 3/185 84/291
4,638,708 A * 1/1987 Kamal ..... G10D 3/06 84/293
4,686,882 A * 8/1987 Shaw ..... G10D 1/08 84/291
4,770,079 A * 9/1988 Mastroianni ..... G10D 3/18 84/267
4,873,908 A * 10/1989 Moore ..... G10D 1/085 211/84
4,890,530 A * 1/1990 Tatsumi ..... G10D 1/085 84/291
5,233,896 A * 8/1993 Worthington ..... G10D 3/06 84/293
5,251,526 A * 10/1993 Hill ..... G10D 1/085 84/263
5,353,672 A * 10/1994 Stewart ..... G10D 3/06 84/267
5,383,385 A * 1/1995 Gilbert ..... G10D 1/085 84/267
5,390,578 A * 2/1995 Raymer ..... G10D 3/06 84/267
5,824,924 A * 10/1998 Agostino ..... G10H 3/18 84/291

(Continued)

FOREIGN PATENT DOCUMENTS

FR 2815757 A1 * 4/2002 ..... G10D 1/085

*Primary Examiner* — David Warren
(74) *Attorney, Agent, or Firm* — C. G. Mersereau; Nikolai & Mersereau, P.A.

(57) ABSTRACT

A foldable guitar includes a body having a base, a neck, a head and multiple strings. A first board is an elongate board and pivotably connected to the rear side of the body. The first board can be located overlapped and parallel to the body. The first board has a recess defined in one end thereof and the recess so as to accommodate a user's arm. A second board is an elongate board and pivotably connected to the rear side of the body. The second board can be located overlapped and parallel to the body. The second board has a protrusion which is received in the recess. The first and second boards can be folded to the rear side of the body to save storage space, or to be arranged according to different users' need.

10 Claims, 9 Drawing Sheets

(56) References Cited

U.S. PATENT DOCUMENTS 5,945,614 A * 8/1999 White ..... G10D 1/08 84/267
5,949,005 A * 9/1999 Peterson ..... G10D 1/085 84/267
5,990,397 A * 11/1999 Taylor ..... G10D 1/085 84/267
5,994,633 A * 11/1999 Norton ..... G10D 1/085 84/290
6,008,440 A * 12/1999 Yamada ..... G10H 3/18 84/291
6,255,565 B1 * 7/2001 Tamura ..... G10D 1/02 84/275
6,353,164 B1 * 3/2002 Corsi ..... G10D 3/06 84/290
6,525,246 B1 * 2/2003 Erismann ..... G10D 1/085 84/267
6,573,439 B2 * 6/2003 Wilson ..... G10D 3/146 84/290
6,664,461 B2 * 12/2003 Tamura ..... G10H 1/32 84/291
6,703,546 B1 * 3/2004 Wilson ..... G10D 3/146 84/290
D516,114 S * 2/2006 Leach ..... G10D 1/08 D17/20
7,112,732 B2 * 9/2006 Tamura ..... G10H 1/32 84/290
RE40,097 E * 2/2008 Erismann ..... G10D 1/085 84/267
7,365,254 B2 * 4/2008 Johansson ..... G10D 1/08 84/293
7,375,267 B2 * 5/2008 Poschelk ..... G10D 1/08 84/291
7,485,785 B1 * 2/2009 Steinberger ..... G10G 5/005 84/327
7,579,535 B2 * 8/2009 Pyper-Scott ..... G10D 1/08 84/267
7,696,419 B2 * 4/2010 Chadwick, V ..... G10D 1/08 84/173
7,872,185 B1 * 1/2011 Chadwick ..... G10D 1/08 84/275
7,902,442 B2 * 3/2011 Leach ..... G10D 1/08 84/293
7,915,505 B2 * 3/2011 Miniaev ..... G10H 1/32 84/291
8,119,892 B2 * 2/2012 Leach ..... G10D 1/08 84/267
8,203,058 B2 * 6/2012 Leach ..... G10D 1/08 84/267
8,273,974 B1 * 9/2012 Gonzalez ..... G10D 1/085 84/267
8,378,192 B1 * 2/2013 Harmon ..... G10D 1/085 84/291
9,224,370 B1 * 12/2015 Sanzo ..... G10D 1/08
9,466,268 B2 * 10/2016 Knight ..... G10D 1/08
9,514,719 B1 * 12/2016 Ward ..... G10D 3/06
2003/0037659 A1 * 2/2003 Wilson ..... G10D 3/146 84/291
2003/0145711 A1 * 8/2003 Tamura ..... G10H 1/32 84/291
2003/0226440 A1 * 12/2003 Sawhney ..... G10D 1/00 84/291
2005/0132866 A1 * 6/2005 Sawhney ..... G10D 1/00 84/291
2007/0056429 A1 * 3/2007 Poschelk ..... G10D 1/08 84/293
2007/0144328 A1 * 6/2007 Johansson ..... G10D 1/08 84/290
2007/0289427 A1 * 12/2007 Liang ..... G10D 1/08 84/291
2008/0141488 A1 * 6/2008 Leach ..... G10D 1/08 16/223
2008/0141842 A1 * 6/2008 Leach ..... G10D 1/08 84/293
2008/0202309 A1 * 8/2008 Wiswell ..... G10D 1/085 84/291
2009/0084243 A1 * 4/2009 Pyper-Scott ..... G10D 1/08 84/293
2009/0100981 A1 * 4/2009 Chadwick, V ..... G10D 1/08 84/293
2009/0151537 A1 * 6/2009 Leach ..... G10D 1/08 84/293
2011/0219935 A1 * 9/2011 Amland ..... G10G 5/00 84/327
2016/0225351 A1 * 8/2016 Knight ..... G10D 1/08

* cited by examiner

FOLDABLE GUITAR

BACKGROUND OF THE INVENTION

1. Fields of the Invention

The present invention relates to a foldable guitar, and more particularly, to a foldable guitar having two boards which are foldable relative to the body of the guitar and provide best support to the users.

2. Descriptions of Prior Art

The conventional practice guitars, silent guitars or electric guitars are generally not able to generate sufficient sound, so that the body gives up the sound box which occupies significant space. In order to be conveniently carried and to be supported on the user's body when being played, the conventional guitars are provided a support frame to replace the sound box.

The support frame is connected to two sides of the body of the guitar and can be removed from the body when not in use. Nevertheless, the two parts of the support frame need extra boxes to be stored and carried, this cause another inconvenient issue.

Some developers develop a foldable guitar wherein there are two curved support members on two sides of the body of the guitar, and each of the two support members has one end thereof pivotably connected to the body. The two support members are able to be pivoted to the front side of the guitar and perpendicular to the face of the body to reduce about half occupied volume so as to conveniently carry. When in use, the two support members are pivoted and expanded to two sides of the body to be supported to the body of the user. The two support members are pivotably attached to the body of the guitar so as to eliminate the problems mentioned above. When the two support members are pivoted to the front side of the guitar can only reduce half of the occupied space, the folded guitar still needs a large space to store and carry.

In addition, the assembled two parts of the support frame and the pivotable support members occupy a large space when they are expanded to be the usable status. This needs to be improved further.

The present invention intends to provide a foldable guitar that eliminates the problems mentioned above.

SUMMARY OF THE INVENTION

The present invention relates to a foldable guitar and comprises a body having a base, a neck, a head and multiple strings. The neck extends from the first end of the base, and the head extends from the distal end of the neck. The base has a bridge connected to the front side of the second end of base. The head has multiple tuning keys and multiple strings are respectively connected between the tuning keys and the bridge. The strings extend above the front side of the neck.

A first board is an elongate board and pivotably connected to the rear side of the body. The first board is capable of being located overlapped and parallel to the body. The first board has a recess defined in one end thereof and the recess is able to accommodate a user's arm.

A second board is an elongate board and pivotably connected to the rear side of the body. The second board is capable of being located overlapped and parallel to the body. The second board has a protrusion extending from one end thereof and the protrusion is located corresponding to the recess and capable of being received in the recess.

The primary object of the present invention is to provide a foldable guitar that has a first board and a second board, and both of the first and second boards are able to be folded to the rear side of the body to save the storage and transportation space. The first and second boards can be pivoted outward to provide support feature. The angular positions of the first and second boards can be set according to individual user's need. The protrusion of the second board is received in the recess of the first board to neatly position the first and second boards at the rear side of the body.

When the first and second boards are pivoted outward, they does not interfere each other. The user's arm can be supported by the recess of the first board such that the user can play the guitar easily and comfortably. Even when the first and second boards are pivoted outward, the space occupied is small so that the foldable guitar is suitable for being played in a small space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
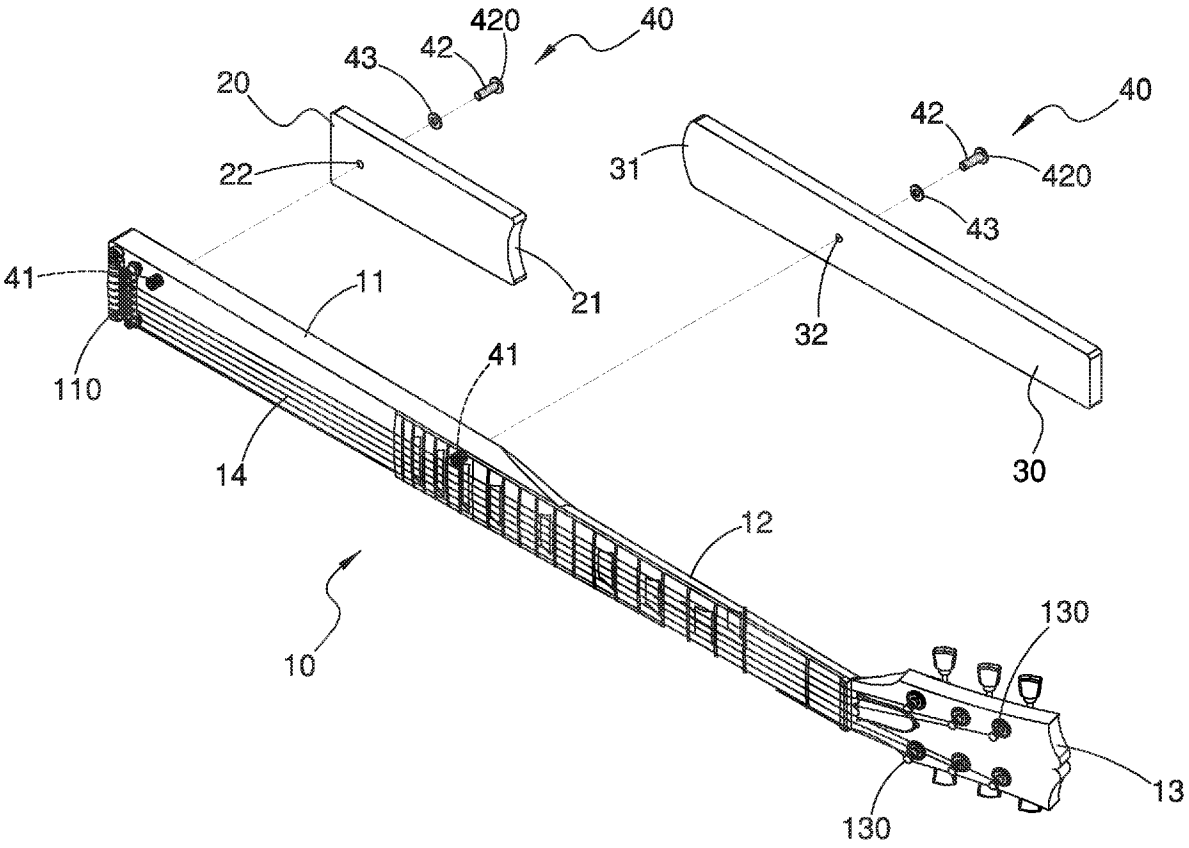
FIG. 1 is an exploded view of the front side of the foldable guitar of the present invention.
Figure 2:
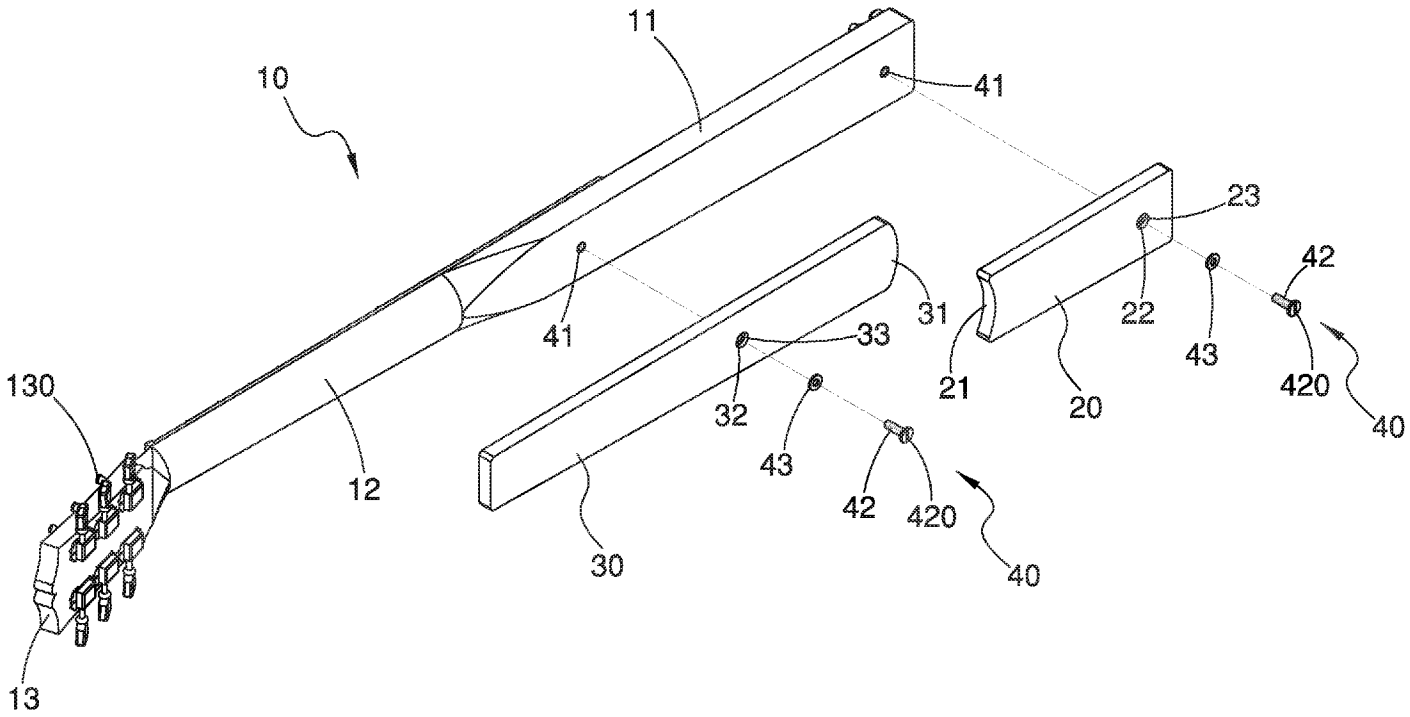
FIG. 2 is an exploded view of the rear side of the foldable guitar of the present invention.
Figure 3:
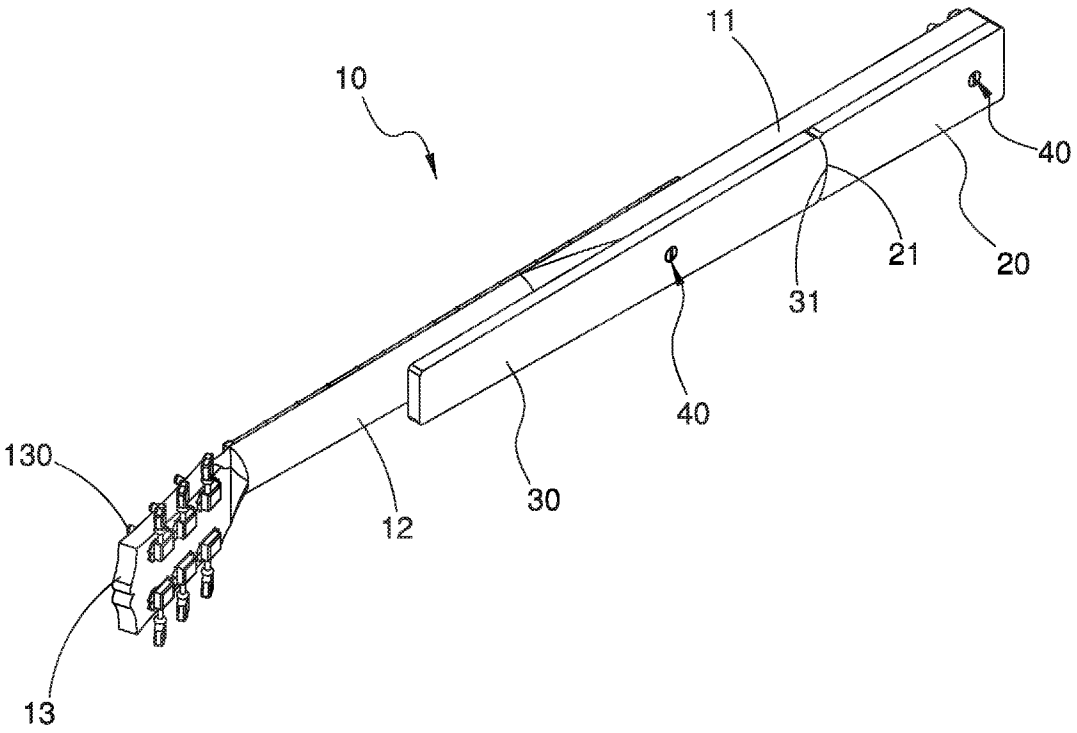
FIG. 3 is a perspective view of the rear side of the foldable guitar of the present invention.
Figure 4:
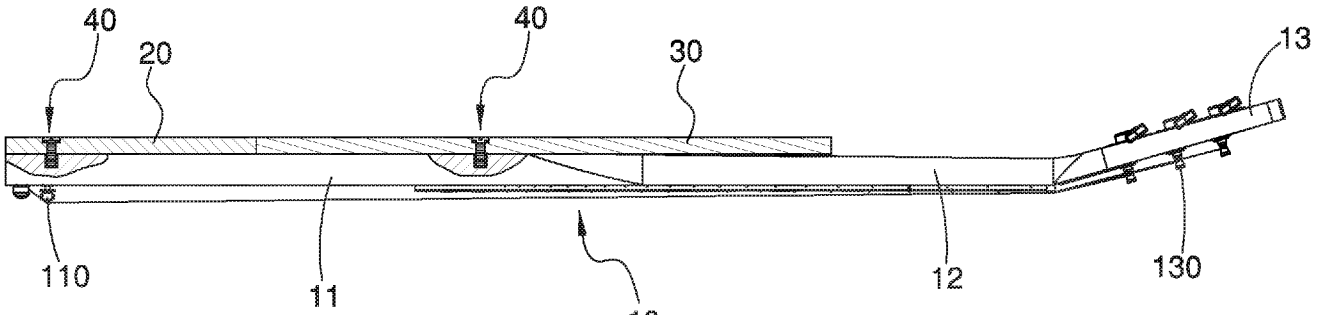
FIG. 4 is a cross sectional view of the foldable guitar of the present invention.
Figure 5:
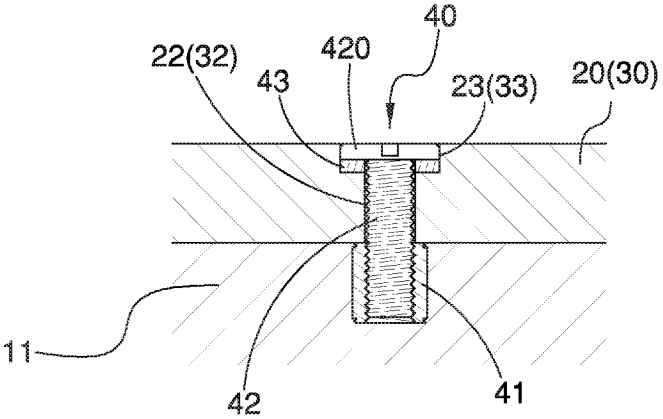
FIG. 5 is an enlarged cross sectional view to show the connection unit for connecting the first/second board to the guitar.

Referring to FIGS. 1 to 8, the foldable guitar of the present invention comprises a body 10 having a base 11, a neck 12, a head 13 and multiple strings 14. The neck 12 extends from the first end of the base 11, and the head 13 extends from the distal end of the neck 12. The base 11 has a bridge 110 connected to the front side of the second end of the base 11. The head 13 has multiple tuning keys 130, and multiple strings 14 are respectively connected between the tuning keys 130 and the bridge 110. The strings 14 extend above the front side of the neck 12.

A first board 20 is an elongate board and pivotably connected to the rear side of the body 10, and is located close to the second end of the base 11. The first board 20 can be located overlapped and parallel to the body 10. The first board 20 has two sides which are shaped to be comply with the shape of two sides of the body 10, so that when the first board 20 is pivoted and overlapped the rear side of the body 10, the first board 20 cannot be seen from the front side of the body 10. The first board 20 has a recess 21 defined in one end thereof and the recess 21 is designed to accommodate or to support the user's arm.

A second board 30 is an elongate board and pivotably connected to the rear side of the body 10, and the second board is located close to the first end of the base 11. The second board 30 can be located overlapped and parallel to the body 10. The second board 30 has two sides which are shaped to be comply with the shape of two sides of the body 10, so that when the second board 30 is pivoted and overlapped the rear side of the body 10, the second board 30 cannot be seen from the front side of the body 10. The second board 30 has a protrusion 31 extending from one end thereof and the protrusion 31 is located corresponding to the recess 21 and can be received in the recess 21.

As shown in FIGS. 1-5, each of the first and second boards 20, 30 is connected to the rear side of the body 10 by a connection unit 40. Each of the connection units 40 includes a nut 41, a bolt 42 and a rubber washer 43. The nut 41 is sink in the rear side of the base 11, the bolt 42 extends through the first board 20 or the second board 30 and is threadedly connected to the nut 41. The bolt 42 extends through the rubber washer 43 which is clamped between a head 420 of the bolt 42 and the first board 20 or the second board 30. The first board 20 has a first hole 22 through which the bolt 42 of the connection unit 40 extends. An enlarged first recess 23 is defined in outside of the first board 20 and co-axially communicates with the first hole 22. The rubber washer 43 and the head 420 of the bolt 42 of the connection unit 40 corresponding to the first board 20 are received in the first recess 23. Similarly, the second board 30 has a second hole 32 through which the bolt 42 of the connection unit 40 extends. An enlarged second recess 33 is defined in outside of the second board 30 and co-axially communicates with the second hole 32. The rubber washer 43 and the head 420 of the bolt 42 of the connection unit 40 corresponding to the second board 30 are received in the second recess 33.

By loosening the bolts 42, the first and second boards 20, 30 can be pivoted relative to the base 11. When the first and second boards 20, 30 are pivoted to desired positions, the bolts 42 are tightened again. The rubber washers 43 resiliently position the first and second boards 20, 30 at desired angles.

Figure 6:
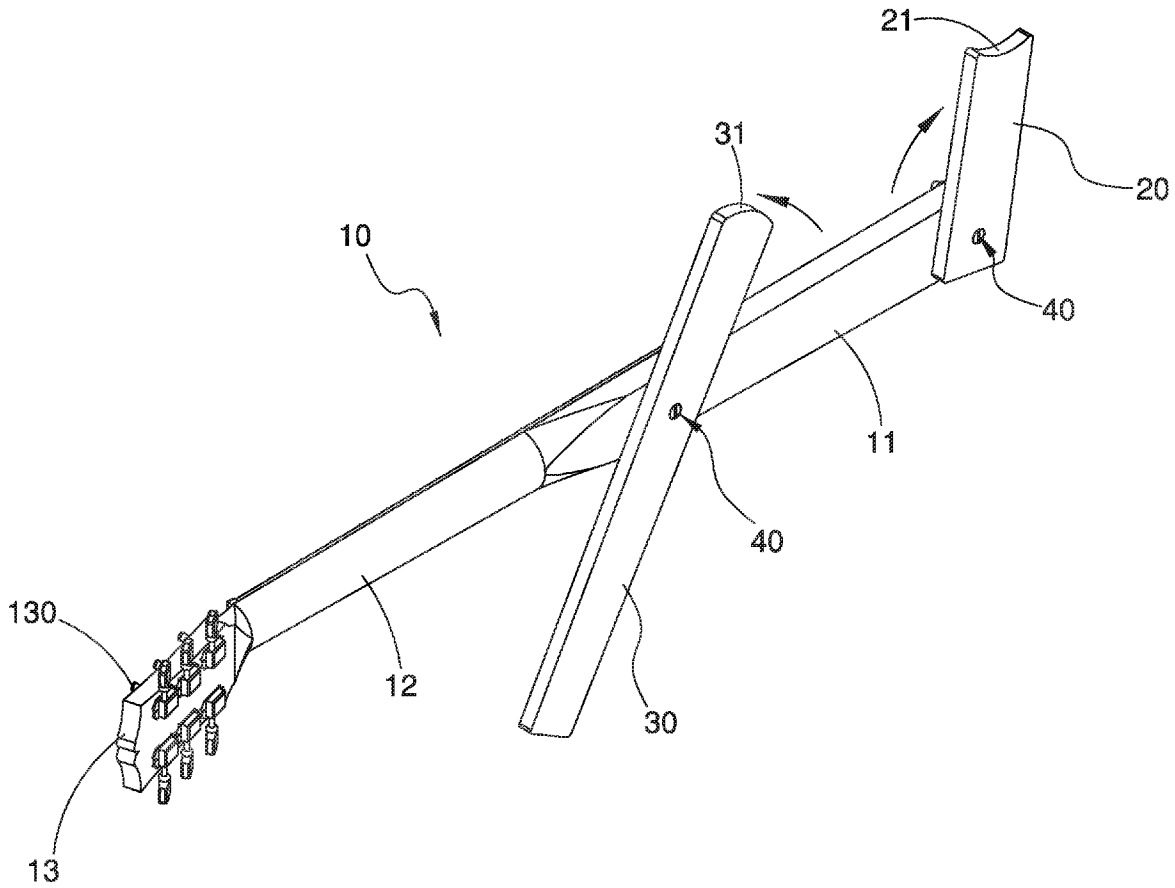
FIG. 6 is a perspective view to show that the first and second boards are pivoted outward.
Figure 7:
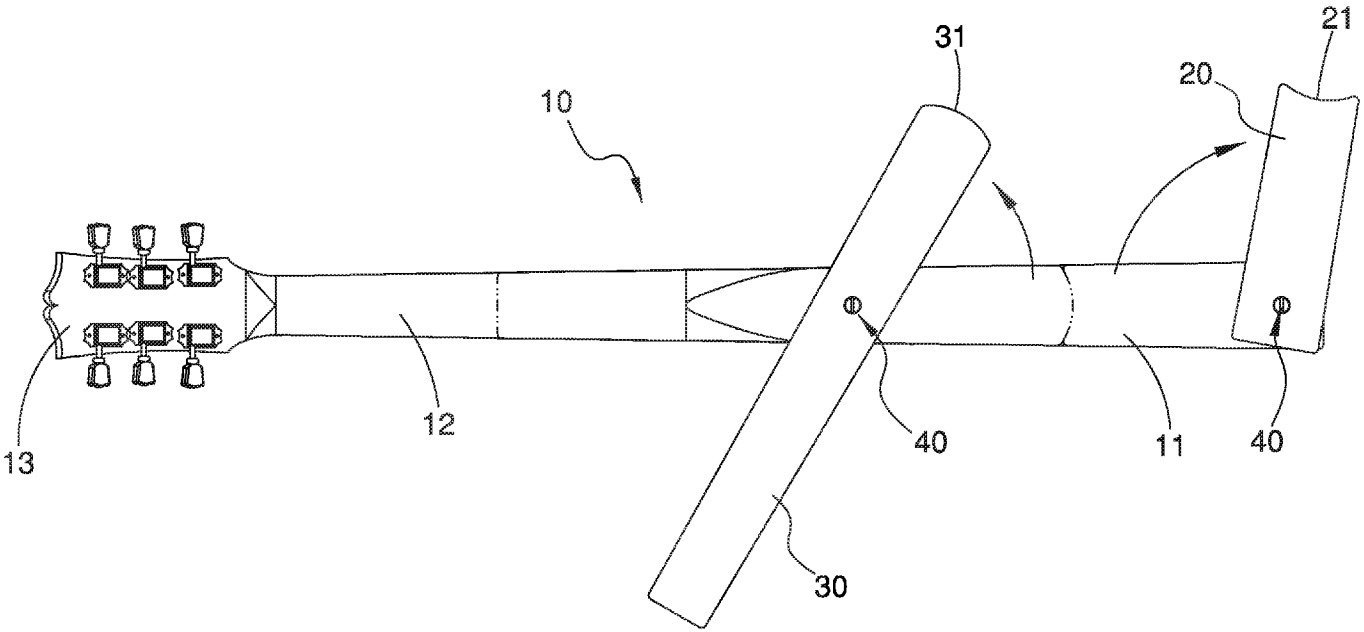
FIG. 7 is a plan view to show that the first and second boards are pivoted outward.
Figure 8:
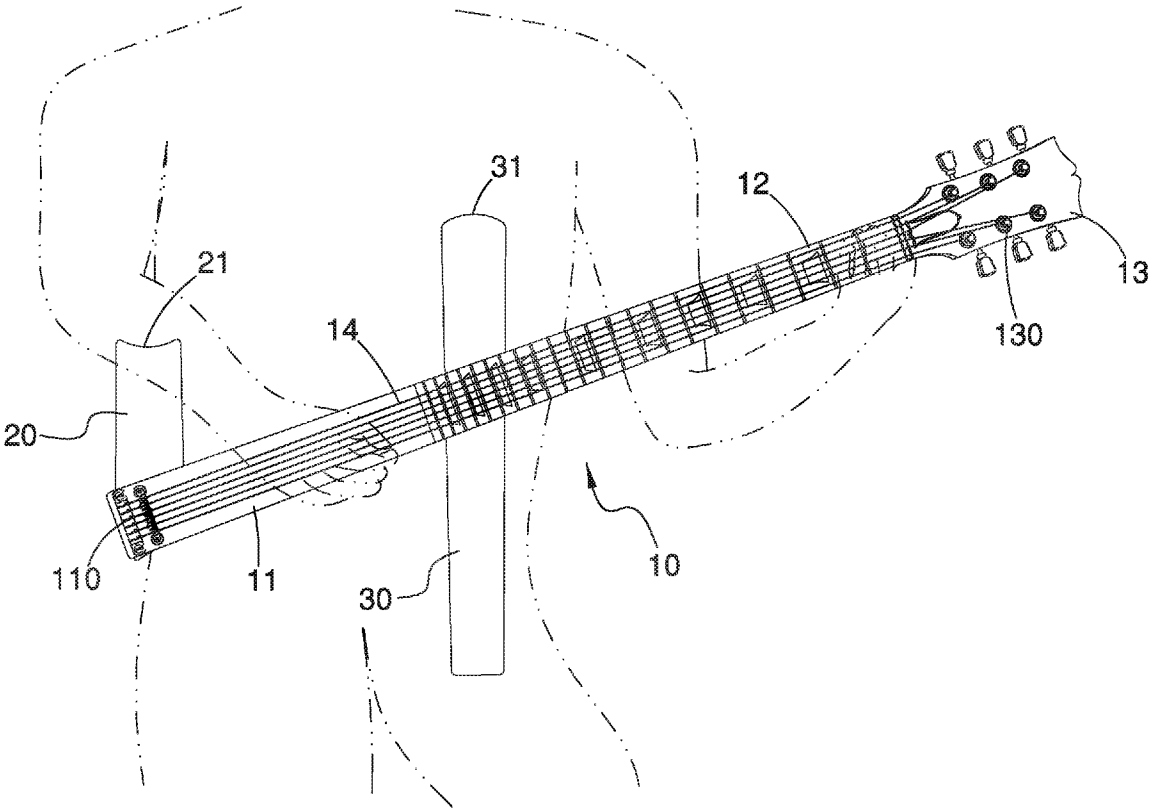
FIG. 8 illustrates a user is playing the foldable guitar of the present invention.

As shown in FIGS. 6 to 8, the angular positions of the first and second boards 20, 30 can be set according to individual user's need. The user's arm can be supported in the recess 21 of the first board 20, and the second board 30 has one end thereof is supported on the user's leg to form a two-point support. The user can comfortably play the guitar. Of course, the other end of the second board 30 can be supported on the chest of the user to form a three-point support. Alternatively, the second end of the base 11 can be supported on the other leg of the user to form a four-point support. The way of use of the first and second boards 20, 30 can be varied according individual user's needs.

Figure 9:
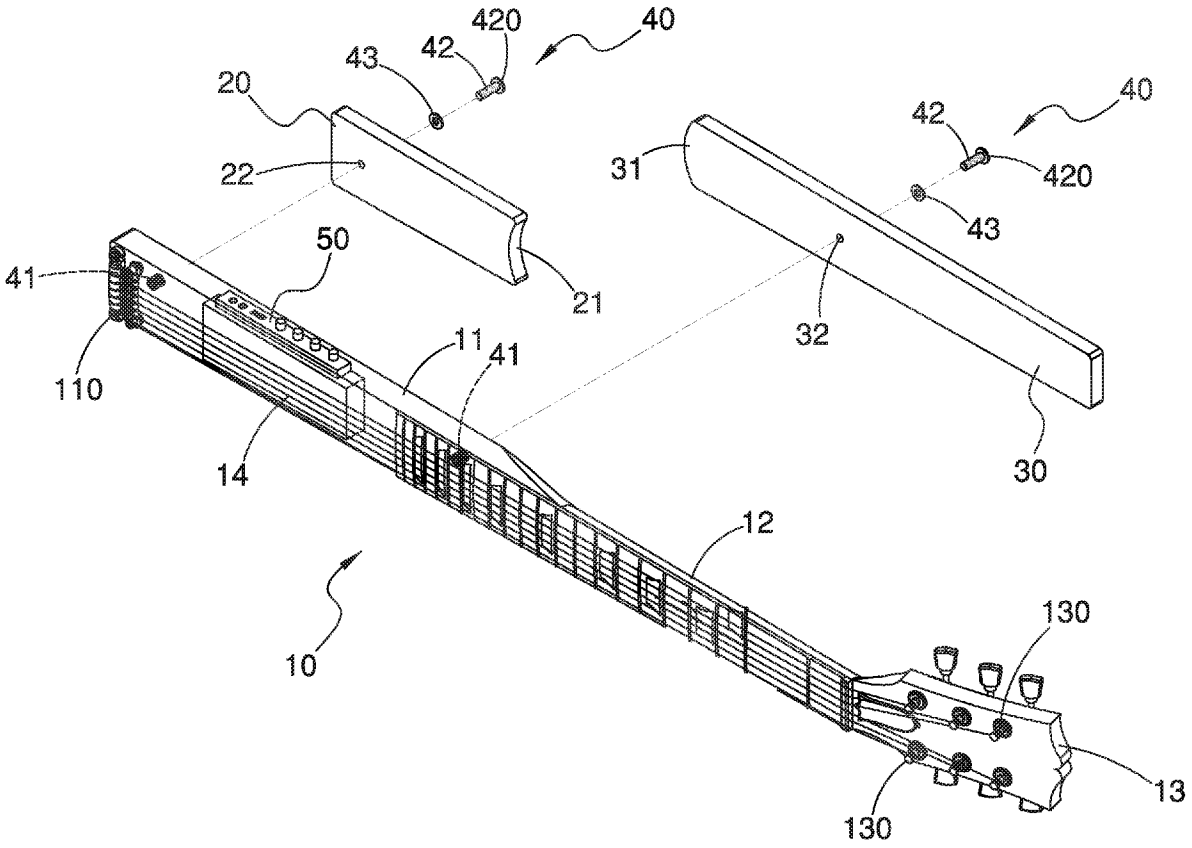
FIG. 9 is an exploded view of the front side of the second embodiment of the foldable guitar of the present invention.

As shown in FIG. 9 which shows the second embodiment of the present invention, the difference from the previous embodiment is that the base 11 has an audio output device 50 connected thereto which is connected with an ear set or an amplifying device, and the user can control the output of the sound from the guitar.

Figure 10:
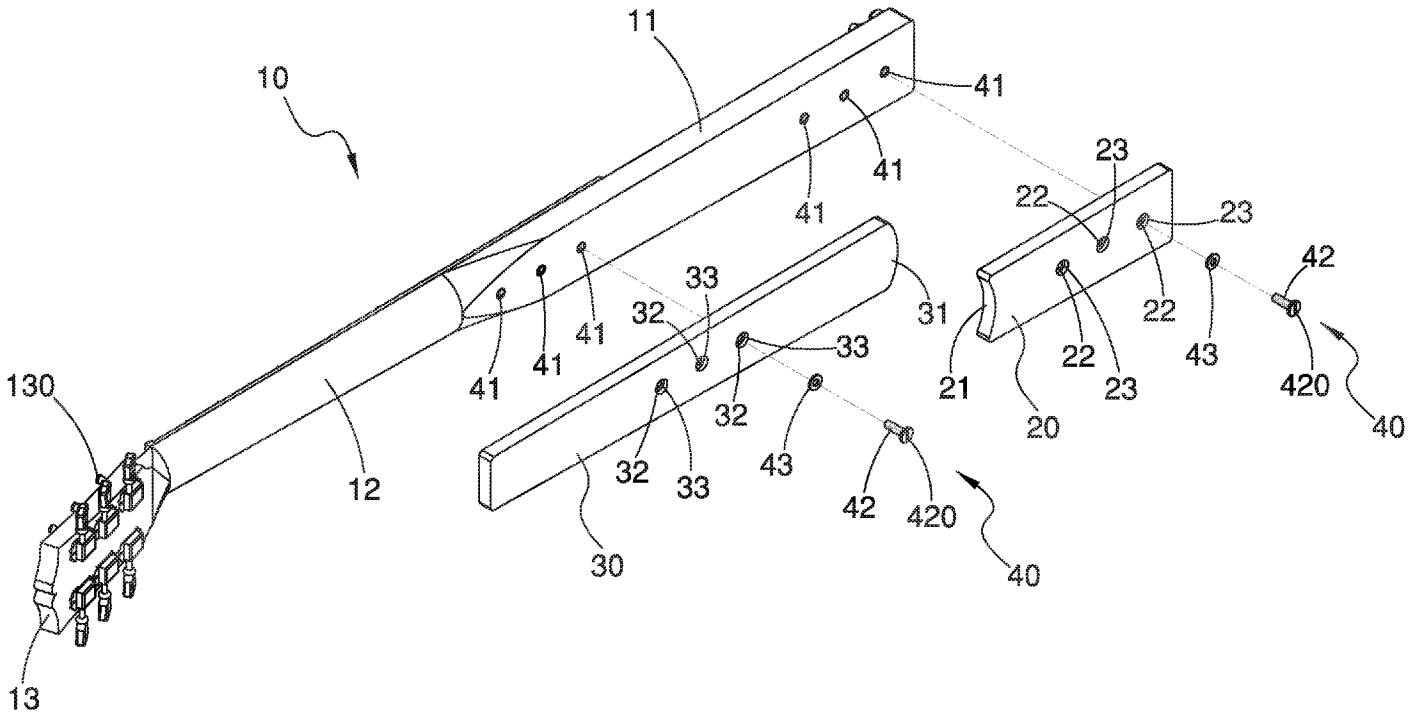
FIG. 10 is an exploded view of the rear side of the third embodiment of the foldable guitar of the present invention.

As shown in FIG. 10 which shows the third embodiment of the present invention, the difference from the first embodiment is that each of the connection units 40 includes multiple nuts 41, a bolt 42 and a rubber washer 43. The nuts 41 are sink in the rear side of the base 11 and separated from each other at even intervals. The first board 20 has multiple first holes 22 and the bolt 42 of the connection unit 40 extends through one of the first holes 22. Multiple enlarged first recesses 23 are defined in outside of the first board 20 and co-axially communicates with the first holes 22. The rubber washer 43 and the head 420 of the bolt 42 of the connection unit 40 corresponding to the first board 20 are received in one of the first recesses 23. Similarly, the second board 30 has multiple second holes 32 and the bolt 42 of the connection unit 40 extends through one of the second holes 32. Multiple enlarged second recesses 33 are defined in outside of the second board 30 and co-axially communicates with the second holes 32. The rubber washer 43 and the head 420 of the bolt 42 of the connection unit 40 corresponding to the second board 30 are received in one of the second recesses 33. The bolt 42 extends through the first board 20 or the second board 30 and is threadedly connected to one of the nuts 41, the rubber washer 43 is clamped between the head 420 of the bolt 42 and the first board 20 or the second board 30. The users extend the bolt 42 through the desired first hole 22 or the second hole 32, and is connected to the desired nut 41, so that different users can comfortably use the guitar.

The foldable guitar of the present invention provides the first and second boards 20, 30 which can be pivoted and positioned at the rear side of the body 10. The first and second boards 20, 30 cannot be seen from the front side of the body 10. The folded guitar is compact and convenient for carry and transportation. When the first and second boards 20, 30 are pivoted outward, they provide support feature. The angular positions of the first and second boards 20, 30 can be set according to practical needs of the users. The first board 20 has a recess 21 and the second board 30 has a protrusion 31 which is engaged with the recess 21 to form an elongate combination and positioned at the rear side of the body 10. When the first and second boards 20, 30 are pivoted outward, the first and second boards 20, 30 do not interfere to each other. The recess 21 of the first board 20 supports the user's arm so that the user can play the guitar comfortably. Even when the first and second boards 20, 30 are pivoted outward, the whole guitar occupies only a small space. The foldable guitar of the present invention is suitable for being played in a small space.

While we have shown and described the embodiment in accordance with the present invention, it should be clear to those skilled in the art that further embodiments may be made without departing from the scope of the present invention.

What is claimed is:

1. A foldable guitar comprising:

a body having a base, a neck, a head and multiple strings, the neck extending from a first end of the base, the head extending from a distal end of the neck, the base having a bridge connected to a front side of a second end of the base, the head having multiple tuning keys and multiple strings respectively connected between the tuning keys and the bridge, the strings extending above a front side of the neck;

a first board being an elongate board and pivotably connected to a rear side of the body, the first board being capable of being located overlapped and parallel to the body, the first board having a recess defined in one end thereof and the recess adapted to accommodate a user's arm, and a second board being an elongate board and pivotably connected to the rear side of the body, the second board being capable of being located overlapped and parallel to the body, the second board having a protrusion extending from one end thereof and the protrusion located corresponding to the recess and capable of being received in the recess.

2. The foldable guitar as claimed in claim 1, wherein the base has an audio output device connected thereto which is adapted to be connected with an ear set or an amplifying device.

3. The foldable guitar as claimed in claim 1, wherein each of the first and second boards has two sides which are shaped to be comply with a shape of two sides of the body, when the first and second boards are pivoted and overlapped the rear side of the body, the first and second boards cannot be seen from the front side of the body.

4. The foldable guitar as claimed in claim 1, wherein the first and second boards are respectively and pivotably pivoted to the rear side of the body.

5. The foldable guitar as claimed in claim 4, wherein the first board is pivotably connected to the base and located close to the second end of the base, the second board is pivotably connected to the base and located close to the first end of the base.

6. The foldable guitar as claimed in claim 1, wherein each of the first and second boards is connected to the rear side of the body by a connection unit.

7. The foldable guitar as claimed in claim 6, wherein each of the connection units includes a nut, a bolt and a rubber washer, the nut is sink in the rear side of the body, the bolt extends through the first board or the second board and is threadedly connected to the nut, the bolt extends through the rubber washer which is clamped between a head of the bolt and the first board or the second boar.

8. The foldable guitar as claimed in claim 7, wherein the first board has a first hole through which the bolt of the connection unit extends, an enlarged first recess is defined in outside of the first board and co-axially communicates with the first hole, the rubber washer and the head of the bolt of the connection unit corresponding to the first board are received in the first recess, the second board has a second hole through which the bolt of the connection unit extends, an enlarged second recess is defined in outside of the second board and co-axially communicates with the second hole, the rubber washer and the head of the bolt of the connection unit corresponding to the second board are received in the second recess.

9. The foldable guitar as claimed in claim 6, wherein each of the connection units includes multiple nuts, a bolt and a rubber washer, the nuts are sink in the rear side of the body and separated from each other at even intervals, the bolt extends through the first board or the second board and is threadedly connected to one of the nuts, the rubber washer is clamped between the head of the bolt and the first board or the second board, the first board has a first hole through which the bolt of the connection unit extends, an enlarged first recess is defined in outside of the first board and co-axially communicates with the first hole, the rubber washer and the head of the bolt of the connection unit corresponding to the first board are received in the first recess, the second board has a second hole through which the bolt of the connection unit extends, an enlarged second recess is defined in outside of the second board and co-axially communicates with the second hole, the rubber washer and the head of the bolt of the connection unit corresponding to the second board are received in the second recess.

10. The foldable guitar as claimed in claim 9, wherein the first board has multiple first holes and multiple first recesses located corresponding to the first holes, the bolt and the rubber washer of the connection unit are received in one of the first holes and one of the first recesses, the second board has multiple second holes and multiple second recesses located corresponding to the second holes, the bolt and the rubber washer of the connection unit are received in one of the second holes and one of the second recesses.

* * * * *